United States Patent [19]

Ainsworth

[11] 4,099,081

[45] Jul. 4, 1978

[54] ELECTRIC LAMPS AND THEIR PRODUCTION

[75] Inventor: Thomas Somner Ainsworth, London, England

[73] Assignee: Thorn Electrical Industries Limited, London, England

[21] Appl. No.: 771,603

[22] Filed: Feb. 24, 1977

[30] Foreign Application Priority Data

Feb. 25, 1976 [GB] United Kingdom ..... 7476/76

[51] Int. Cl.[2] ..... H01J 61/26

[52] U.S. Cl. ..... 313/174; 313/227; 316/25

[58] Field of Search ..... 313/174, 178, 179; 316/3, 25

[56] References Cited

U.S. PATENT DOCUMENTS 3,898,500 8/1975 Johnson et al. ..... 313/174

*Primary Examiner*—Rudolph V. Rolinec
*Assistant Examiner*—Darwin R. Hostetter
*Attorney, Agent, or Firm*—Robert F. O'Connell

[57] ABSTRACT

The invention relates to the production of metal halide discharge lamps. Residual water vapor within the envelope of metal halide discharge lamps is gettered by the inclusion of a small quantity of phosphorus. By this means it is possible to dispense with complexities in the conventional manufacture of such discharge lamps arising from the hygroscopic nature of many metal halides.

6 Claims, 1 Drawing Figure

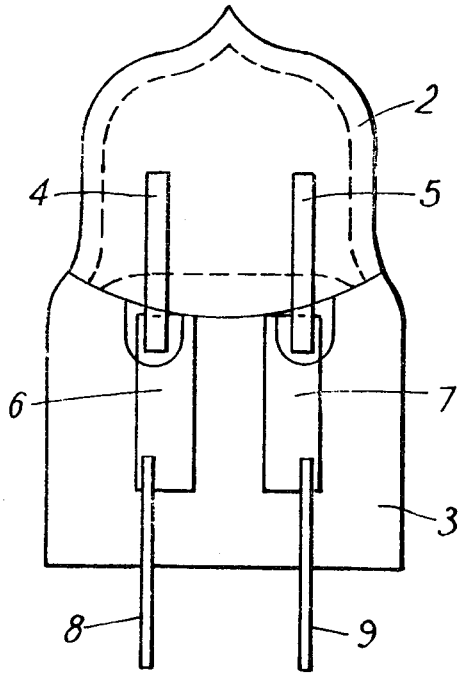
2
4
5
6
7
3
8
9

ELECTRIC LAMPS AND THEIR PRODUCTION

The present invention relates to electric lamps containing metal halides, and more especially to metal halide discharge lamps.

Metal halide lamps are more difficult to exhaust in the course of production than the corresponding plain mercury discharge lamps, mainly because the metal halides are hygroscopic. Traces of water vapour are consequently difficult to eliminate from the finished lamp and, because of the well known "water cycle", even a small trace of water has a serious effect on lamp life. The "water cycle" is described in the "Collected Works of Irving Langmuir", Volume 2, page 185 (Pergamon Press 1960).

The use of dry boxes in storing and weighing the metal halide doses and the heating and recondensing of the metal halides within the lamp envelope during the exhaust procedure are methods which have been used in attempts to eliminate traces of water vapour from the filling of the lamp.

However, a dry box, capable of holding the partial pressure of water vapour at the very low values required to keep the metal halides dry, is expensive to install and difficult to maintain. The heating and recondensing of the metal halides during the exhaust procedure is a hand operation and can result in a partial loss of the metal halide dose, particularly with smaller sizes of lamp. The elimination of this step would simplify the exhaust procedure and facilitate machine exhaust techniques.

It has now been found in accordance with this invention that similar lamp lives can be obtained from metal halide lamps without the use of either an expensive dry box or heating and condensing of the metal halide during the exhaust procedure simply by including a small quantity of phosphorus in elementary or combined form, in the lamp filling with the metal halide dose.

According to this invention, therefore, an electrical discharge lamp comprises a lamp envelope, electrodes and leads therefor and a vapour fill including metal halide and sufficient phosphorus to getter residual water vapour inside the envelope. Too much phosphorus added in this way will result in a dense coloured vapour when the lamp is operating, which will affect both the luminous efficacy and the colour of the light from the lamp. Less than 0.1 mg per cc and more especially less 0.05 mg/cc of phosphorus should preferably be added.

In one particular example of the practice of this invention a 400-watt high pressure mercury quartz compact source arc tube with metal additive (a so-called "C.S.I." lamp) was made, using gallium as the added metal.

In accordance with the invention, the normal 0.2 mg dose of gallium metal used in such a lamp was replaced by 0.3 mg of gallium phosphide and the normal heating and condensing of the metal halides during the exhaust procedure was omitted. Subsequent life tests showed no deterioration in performance as compared with the conventional C.S.I. lamp.

Gallium phosphide was used in this instance since gallium was already a constituent of the lamp filling and gallium phosphide is easily obtained in very pure form (from the semi-conductor industry) and may be stored without special precautions.

The accompanying drawing is an elevational view of a discharge lamp which can incorporate phosphorus in accordance with the present invention.

The lamp shown in the drawing has a vitreous envelope 2 formed with a seal portion 3. Refractory metal electrodes 4 and 5 within the envelope are connected to molybdenum ribbons 6 and 7 within the sealed portion and the latter are connected to respective external leadwires 8 and 9.

The fill within the envelope 2 includes mercury and a metal halide and in accordance with the invention an effective amount of phosphorus is added, for example in the form of a metal phosphide, to getter residual water vapour inside the envelope, more especially moisture introduced with a metal halide.

I claim:

1. An electrical discharge lamp comprising a lamp envelope, electrodes and leads therefor and a vapour fill including metal halide and a quantity of phosphorus in the form of a metal phosphide sufficient to effectively getter water vapour inside the envelope but insufficient to affect the luminous efficacy of light from said lamp.

2. A lamp according to claim 1 wherein the quantity of phosphorus is less than 0.1 mg per c.c.

3. A lamp according to claim 1, wherein said metal phosphide comprises the same metal as said metal halide.

4. A lamp according to claim 1, wherein said metal phosphide is gallium phosphide.

5. A lamp according to claim 4 wherein the quantity of said phosphorus is less than 0.1 mg. per cc.

6. In the manufacture of an electrical discharge lamp comprising a lamp envelope, electrodes and leads therefor and a vapour fill including metal halide the improvement which comprises eliminating traces of water vapour from the finished lamp by the steps of:

introducing into the lamp envelope a quantity of phosphorus in the form of a metal phosphide sufficient to effectively getter said residual water vapour but insufficient to affect the luminous efficacy of light from said lamp;

sealing said envelope; and operating said lamp and thereby causing said phosphorus to getter said water vapour.

* * * * *